United States Patent [19]

Prins et al.

[11] 4,351,398

[45] Sep. 28, 1982

[54] WELL DRILLING APPARATUS

[76] Inventors: Klaar Prins, Savornin Lohmanlaan 7, Velsen; Reinout K. N. J. Prins, Dorpsstraat 940, Assendelft, both of Netherlands

[21] Appl. No.: 57,429

[22] Filed: Jul. 13, 1979

[51] Int. Cl.[3] ..... E21B 3/04; E21B 15/00

[52] U.S. Cl. ..... 173/104; 173/165; 175/85; 175/195

[58] Field of Search ..... 166/79, 85; 175/85, 175/195, 5; 173/165, 166, 104, 46

[56] References Cited

U.S. PATENT DOCUMENTS

| | | | |
|---|---|---|---|
| 2,981,346 | 4/1961 | Bauer et al. | 173/165 X |
| 3,593,808 | 7/1971 | Nelson | 173/165 X |
| 3,695,363 | 10/1972 | Kelly, Jr. | 175/85 X |
| 3,981,369 | 9/1976 | Bokenkamp | 175/85 X |
| 4,081,163 | 3/1978 | Guinn et al. | 173/165 X |

FOREIGN PATENT DOCUMENTS

| | | | |
|---|---|---|---|
| 7800669 | 7/1979 | Netherlands | 166/79 |

*Primary Examiner*—Werner H. Schroeder
*Assistant Examiner*—Andrew M. Falik

[57] ABSTRACT

A drill rig for drilling wells having a derrick adapted to hold and lower a conductor string and drill pipe string. A support frame is fixed to the derrick to extend over the well to be drilled, and a rotary table, for holding and rotating drill pipe strings, is movably mounted thereon. The table is displaceable between an active position in alignment with the axis of the well and an inactive position laterally spaced therefrom. A drill pipe holder is movably mounted on the frame below the rotary table for displacement between a first position laterally of the axis of the well and a second position in alignment with the axis of the well. The rotary table and said drill pipe holder are displaced in opposition to each other, so that the rotary table may be removed from alignment with the axis of the well and said drill pipe string simultaneously held without removal from said well.

1 Claim, 2 Drawing Figures

WELL DRILLING APPARATUS

The invention relates to apparatus for introducing a conductor into the bottom of a well when drilling an oil- or gas well, particularly for use in off-shore drilling operations.

Derricks have been known in which a rotary table is provided which can be displaced to a lateral, inactive position, whereby it serves to introduce into the completed well large pieces, for example blow-out preventers.

The present invention has as its object apparatus particularly suitable for carrying out a method for introducing the conductor and drill strings before drilling and hammering have to be aternately carried out.

This problem is solved by the present invention in providing a rotary table mounted on a frame so that it is movable between an inactive position beyond the path of the conductor and an active position. The frame is adapted to be situated just below the plane of the rotary table and, when the table is in its inactive position, is provided with means for retaining this drilling string.

The apparatus according to the present invention permits catching, after predrilling has been carried out with the intermediary of the rotary table situated in its active position, the relative drilling string, which is suspended in the conductor, through the laterally movable means below the rotary table, such that the drilling string may be released from the rotary table and the rotary table may be moved to its inactive position, in which position sufficient space has been cleared for passing the hammering block. The drilling string may then be connected to the lower end of an intermediary piece whih is to be provided on the conductor, which has to be introduced further into the bottom by hammering, whereafter the conductor with the drilling string suspended therewithin may be further introduced into the bottom by hammering.

In a preferred embodiment the derrick is constituted by a column which is excentrically positioned relative to the axis of the active rotary table position. The column carries at least one hoisting arm and is provided with vertical guide means for a hammering device. The guide means and the hammering device are pivotable between an inactive position and an active position. While in the active position, the axis of the hammering device coincides with the axis of the active rotary table position.

The invention is further explained herebelow with reference to the drawing of an embodiment.

Figure 1:
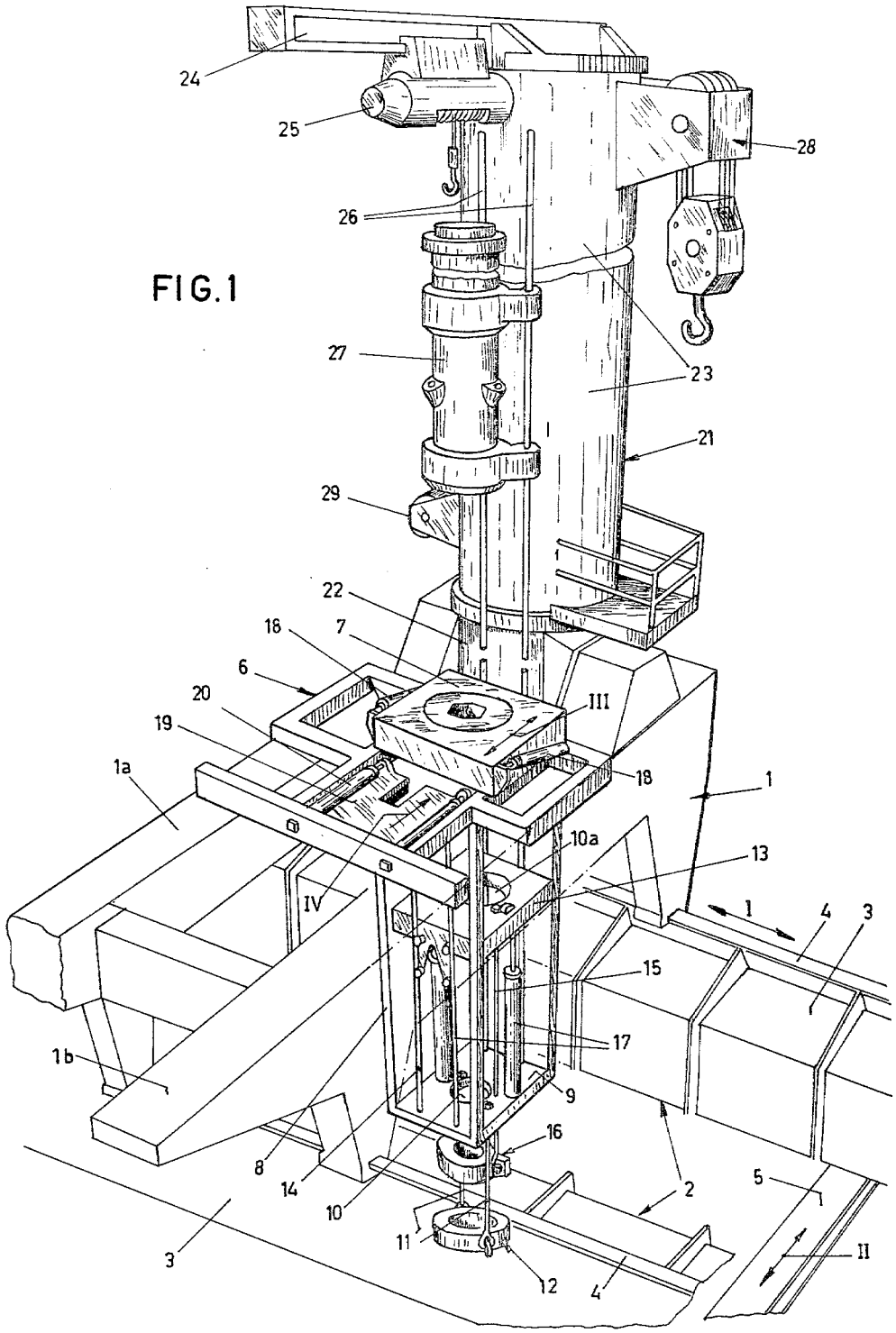
FIG. 1 shows a perspective view of the device according to the invention.

The apparatus as shown in the drawing comprises a portal shaped carrier 1 movable reciprocably in the direction of the arrow I. The carrier is mounted on a bridge 2 which extends in the transverse direction to the well-series to be drilled. The bridge 2 comprises two drilling mud tanks 3 and has two rails 4 on which the carrier is movably supported. The bridge 2 is supported by two rails 5 extending in the longitudinal direction to the well series to be drilled. The rails 5 may constitute the so called "skid beams" which form part of the fixed structure of a drilling platform or production platform and enable the bridge 2 with the carrier 1 to be traversable in the longitudinal direction of the well series, in the direction of arrow II.

A horizontal frame 6 (see FIG. 1) is supported by the carrier 1, on which, on the one hand a rotary table 7 is supported and from which on the other hand is detachably suspended a cagelike structure 8. The cage structure extends downwardly between the side parts 1*a* and 1*b* of the carrier 1 and at a level situated below that of the bridge 2. The cage 8 comprises a floor 9 having a central aperture 10 through which may pass drilling strings and conductors as well as, if necessary, a transition or adapter piece to be used when hammering the conductors.

A fixed pipe tong 12 is suspended from the floor 9 through two releasable tie rods 11. The pipe tong 12 is a pneumatically or hydraulically contractable and expandable type, which is known per se and therefore only schematically shown in the drawing.

Spaced above and parallel to the floor 9 is a platform 13 which is movable up and down being guided along vertical guide rods 14 secured in the cage 8. The platform 13 is provided with a central aperture 10*a*, aligned with the aperture 10, through which conductors, drilling strings and adapter pieces if any may be passed. A second pipe tong 16 is suspended from the platform 13 by tie rods 15. The pipe tong 16 may be of the same type as the pipe tong 12 and is provided between the floor 9 and the pipe tong 12. The guide rods 14 are releasably connected to the supporting platform 13 and extend downwardly through apertures in the floor 9.

The platform 13 with the movable pipe is movable upwardly and downwardly by two hydraulic piston-cylinder assemblies 17, the cylinders of which are fixedly mounted on the floor 9 while the piston rods are connected to the supporting platform 13.

In order to permit movement of the device in the direction of the arrow II along the rails 5 it sometimes may be necessary to release the pipe tongs 12 and 16 with the tie rods 11 and 15 respectively from the cage 8.

The rotary table 7 which may be of a type known per se, is movable in the direction of the arrow III between the active position shown in FIG. 1 and a laterally situated inactive position by two piston-cylinder assemblies 18. In the inactive position the rotary table 7 clears a wide passing aperture provided in the supporting frame 6 (which is not shown in detail in the drawing), through which aperture conductors, drilling strings, adapter pieces and even a hammering block may well pass. Further the rotary table 7 is drivable in known manner by a power source and coupling not further shown herein, such as shown in U.S. Pat. No. 2,981,346, dated Apr. 25, 1961.

A member 19 is also mounted in the supporting frame 6 which is movable through two piston-cylinder assemblies 20 in the direction of arrow IV from an inactive position as shown in the drawing to an active position. This member 19 serves to temporarily receive and retain drilling strings, particularly during the period in which the rotary table is in the inactive position.

The derrick of the device according to the invention, serving for the necessary hoisting, is formed of a column generally depicted by the numeral 21 positioned on the carrier 1 excentrically with respect to the well to be drilled. This column comprises a base 22, fixedly mounted on the carrier 1 and on which the column 23 proper is rotatably journalled. The rotatable column 23 carries a load arm 24 at its upper end, from which a hoist 25 adapted for raising and lowering conductors is suspended and is itself movable in the radial direction. The rotatable column 23 further comprises a pair of vertical guideways 26 along which a hammering machine is mounted to move upwardly and downwardly, while adjacent to the upper end of the column a hoist 28 is provided which is aligned with respect to the axis of the rotary table (in any case in the active position thereof). This hoist, is adapted for lowering and raising drilling strings and cooperates with a winch 29 provided at the base of the rotatable column 21.

The introduction into the bottom of a conductor series, by means of the above described device, is now discussed in detail, with reference to FIGS. 2A to 2H.

Figure 2A:
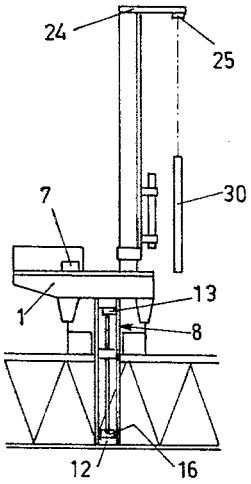
FIGS. 2A to 2H show the device according to the invention in a plurality of successive positions when introducing a conductor series into the bottom under water.
Figure 2B:
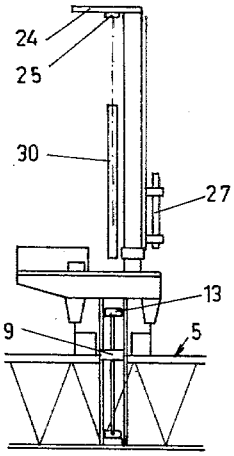
Figure 2C:
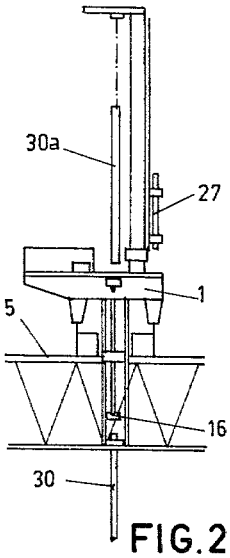
Figure 2D:
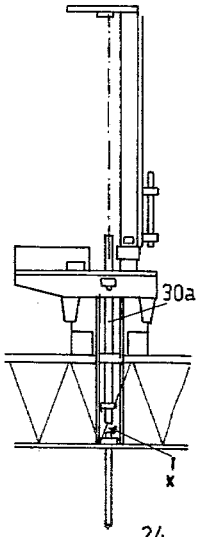
Figure 2E:
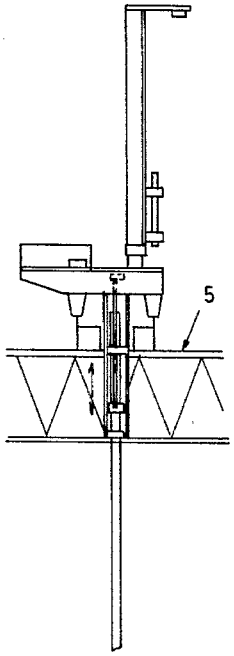

FIG. 2A shows the apparatus of the invention in a position in which the load arm 24 is in a position in which the first conductor 30 has been taken from stock. The rotary table 7 is in the laterally retracted inactive position while the hammering machine 27 and the hoisting position 28 are likewise in the inactive position. In the position according to FIG. 2B the load arm 24 and the hoist 25 and the conductor 30 suspended therefrom have been moved to a position over the axis of the well to be drilled. In this position the conductor 30 is lowered until it may be grasped at its lower end by the pipe tongs 12 and 16. The conductor 30 is further released from the load arm 24 in order to be further lowered by the pipe tongs 12 and 16. The movable pipe tong 16 is maneuvered such that the upper end of the conductor 30 just extends above the pipe tong 16 when the supporting platform 13 with the pipe tong 16 are in their lower positions. The pipe tong 12 is then energized while the pipe tong 16 is actuated to its inactive condition in the upper position, ready for clamping the lower end of a next conductor **30*a* which in the meantime has been raised by the cleared load arm which had been pivoted to the position according to FIG. 2A and thereafter has been pivoted back in alignment over the well axis. This phase is illustrated by FIG. 2C and FIG. 2D. In the position according to FIG. 2D, both conductors 30 and 30*a* may be mutually welded at x. Thereafter by alternatiely energizing the pipe tongs 12 and 16 and moving the pipe tong 16 upwardly and downwardly the conductor set 30, 30*a* may be lowered stepwise (see FIG. 2E) i.e. until the upper end of the conductor set just extends above the lower fixed pipe tong and, therefore, is in a position in which it may be welded to the lower end of a next conductor. The supply and lowering of further conductors is continued until the lowermost conductor of the series can not further penetrate the earth under the influence of the own weight. Then the moment has arrived in which the rotatable column 23 with the hoist 28 is rotated to the active position in order to pick up a drilling string series from a stock, e.g. provided around the column, to connect the series and to lower it within the conductor series which has already been introduced. Thereupon the rotary table 7 is moved to its active position in order to serve first as pipe tong and thereby to stepwise lower the "growing" drilling string series and secondly, as the means for rotating the drill. After, if necessary, hammering takes place with the drilling string series suspended in the conductor series, for which purpose the rotary table 7 has been temporary laterally moved out of the way, drilling takes place with the intermediary of the rotary table 7 and the conventional kelly 31 belonging thereto (see FIG. 2F**).

By driving the rotary table through conventional disengageable couplings and power source, such as that shown in U.S. Pat. No. 2,981,346, a hole is predrilled to a depth beyond the lower point of the conductor series, in which hole the conductor series may be further lowered and may be further driven into the bottom by hammering (see the phase according to FIG. 2G). Before the phase according to FIG. 2G can take place of course, first the kelly 31 must be released and the rotary table has to be repositioned in its inactive position. The member 19 is moved to its active position and the drilling string series is then temporary retained, i.e. until the moment in which the upper drilling string has been coupled to the lower end of a conventional transition or adapter piece 32 to be placed on the upper end of the upper conductor. Thereafter, the device is ready for carrying out the hammering phase according to FIG. 2G.

Figure 2F:
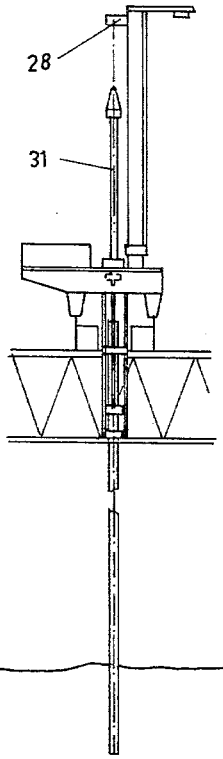
Figure 2G:
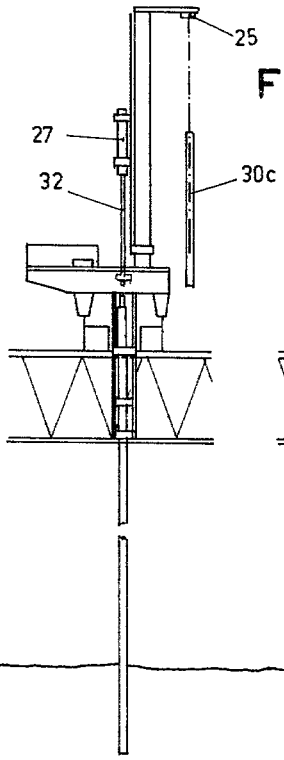
Figure 2H:
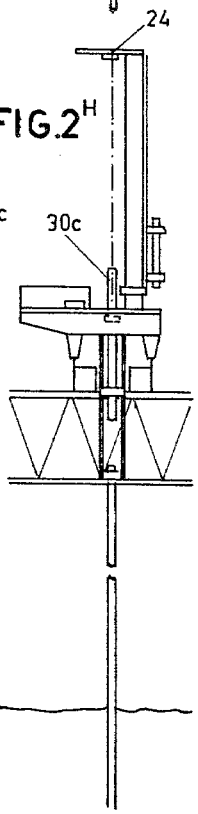

When in this way a predetermined resistance against further penetration into the bottom has again been obtained, the device is again moved to a position in which, by connecting further drilling strings, the drilling is continued, whereafter again a hammering phase follows and so on. FIG. 2F shows that during the hammering, the load arm 24 may be actuated for picking up a next conductor **30*c*. The introduction of this conductor may take place after the hammering machine has been moved to its inactive position (see FIG. 2H**).

We claim:

1. In a drill rig for drilling wells, a derrick adapted to hold and lower a conductor string and drill pipe string, means for holding the lowered conductor string, a support frame fixed to said derrick to extend over the well to be drilled, a column excentrically positioned relative to the support frame, said column carrying at least one load arm and vertical guide means for a hammering device, said load arm, guide means and said hammering device being selectively rotatably adjustable between an active position in alignment with the support frame and an inactive position out of alignment therewith, a rotary table for holding and rotating the drill pipe string, said rotary table being movably mounted on said frame to be displaceable between an active position in alignment with the axis of the well and an inactive position laterally therefrom drill pipe holding means movably mounted on said frame below said rotary table for displacement between a first position laterally of the axis of said well and a second position in alignment with the axis of said well, and means for displacing said rotary table and means for displacing said drill pipe holding means, whereby said rotary table may be removed from alignment with the axis of the well and said drill pipe string simultaneously held without removal from said well.

* * * * *